US005692553A

United States Patent [19]

Jensen

[11] Patent Number: 5,692,553

[45] Date of Patent: Dec. 2, 1997

[54] VERTICAL BLIND RETAINING DEVICE

[76] Inventor: Charles A. Jensen, 709 Houghton Rd. Apt. 308, Kelowna, Canada, V1X7J7

[21] Appl. No.: 689,481

[22] Filed: Aug. 8, 1996

[51] Int. Cl.[6] ..... E06B 9/38

[52] U.S. Cl. ..... 160/178.1 V; 160/349.2

[58] Field of Search ..... 248/221.11; 160/178.1 R, 160/178.1 V, 349.2, 349.1; 211/70.5, 60.1; 292/259 R

[56] References Cited

U.S. PATENT DOCUMENTS

| | | | |
|---|---|---|---|
| 1,291,015 | 1/1919 | Keller | 160/349.2 X |
| 1,654,002 | 12/1927 | Kleinhamer | 160/349.2 |
| 1,836,018 | 12/1931 | Dover | 160/349.2 X |
| 2,219,253 | 10/1940 | Cunningham | 160/349.2 |
| 2,251,512 | 8/1941 | Bush et al. | 160/349.2 |
| 2,260,194 | 10/1941 | Pidot | 160/349.2 |
| 2,293,609 | 8/1942 | Livingston | 160/349.1 X |
| 2,692,018 | 10/1954 | Palm | 160/349.2 |
| 4,062,453 | 12/1977 | Gorlach | 211/70.5 |
| 4,429,911 | 2/1984 | O'Neal et al. | 292/259 R |

FOREIGN PATENT DOCUMENTS

| | | | |
|---|---|---|---|
| 226475 | 10/1910 | Germany | 160/349.1 |
| 1902233 | 8/1970 | Germany | 160/349.2 |

*Primary Examiner*—Blair Johnson

[57] ABSTRACT

A vertical blind retaining device including a bracket. The bracket has a back member with a pair of wings projecting outwardly and extending from opposite ends of the back member. Each wing is extended at a ninety degree angle from the back member. Each wing has a slot and a plurality of mounting holes. The mounting holes are used when mounting the bracket to a wall of a window frame. Lastly, a retaining plate is seated within the slots of the bracket. The retaining plate has a bottom end with a notch cut into each corner. The notch is for coupling with a closed end of the corresponding slot of the bracket. The retaining plat is capable of securing a vertical blind compressed within the bracket when the bracket is attached to the window frame.

1 Claim, 3 Drawing Sheets

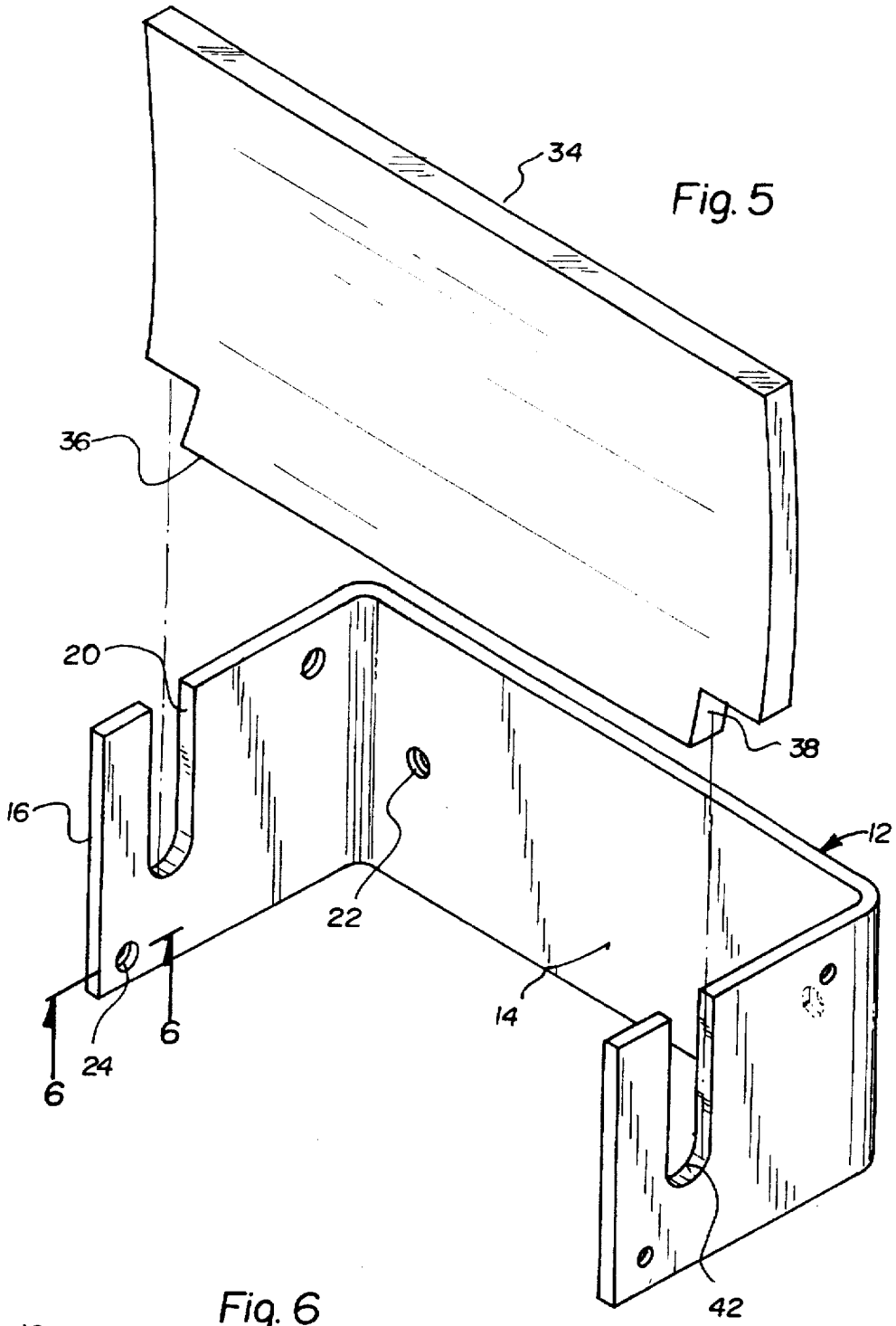
Fig. 5
Fig. 6
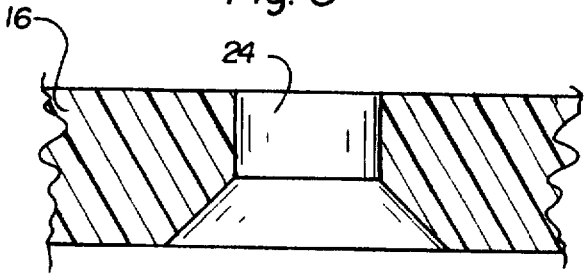

VERTICAL BLIND RETAINING DEVICE

BACKGROUND OF THE INVENTION

1. Field of the Invention

The present invention relates to a vertical blind retaining device and more particularly pertains to providing an easy to use device for holding the vertical blinds in a compressed position against the window frame.

2. Description of the Prior Art

The use of a blind restraining device is known in the prior art. More specifically, blind restraining devices heretofore devised and utilized for the purpose of holding blinds are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,163,492 to Remington and Meehan discloses a vertical blind vane tilt control lock. U.S. Pat. No. 5,074,351 to Sandler discloses a venetian blind restraining device. U.S. Pat. No. 4,312,165 to Mizusawa discloses a bracket for head of panel fastener. U.S. Pat. No. 4,062,453 to Gorlach discloses a device for storage of skis. U.S. Pat. No. 3,985,324 to Larson discloses a tool holder for pegboard. Lastly, U.S. Pat. No. 3,187,902 to Nelson discloses multiple tool holders.

While these devices fulfill their respective, particular objectives and requirements, the aforementioned patents do not describe vertical blind retaining device that allows a retainer plate to compress vertical blinds within a bracket and hold the blinds to allow light to pass through the window.

In this respect, the vertical blind retaining device according to the present invention substantially departs from the conventional concepts and designs of the prior art, and in doing so provides an apparatus primarily developed for the purpose of providing an easy to use device for holding the vertical blinds in a compressed position against the window frame.

Therefore, it can be appreciated that there exists a continuing need for a new and improved vertical blind retaining device which can be used for providing an easy to use device for holding the vertical blinds in a compressed position against the window frame. In this regard, the present invention substantially fulfills this need.

SUMMARY OF THE INVENTION

In view of the foregoing disadvantages inherent in the known types of blind restraining devices now present in the prior art, the present invention provides an improved vertical blind retaining device. As such, the general purpose of the present invention, which will be described subsequently in greater detail, is to provide a new and improved vertical blind retaining device and method which has all the advantages of the prior art and none of the disadvantages.

To attain this, the present invention essentially comprises a generally U-shaped bracket. The bracket has a back member with a pair of wings projecting outwardly. The pair of wings extending from opposite ends of the back member at a ninety degree angle. The pair of wings are in a parallel planes. The bracket has a width from about 4 inches. The bracket has a height of about 1½ to about 2½ inches. The back member has an outer width of about 4 inches and an inner width of about 3¾ inches. Each wing has a length of about 2 to 3¼ inches. Each wing has a slot with a width of about ¼ inches. The bracket has a plurality of mounting holes for use when mounting the bracket to a wall of a window frame. Lastly, a generally rectangular retaining plate is seated within the slots of the bracket. The retaining plate is slightly convex. The retaining plate has a width of about 4⅓ to 4¼ inches and a length of about 1½ to 2½ inches. The retaining plate has a thickness of about ⅛ inches. A bottom end of the retaining plate has a notch cut into each corner for coupling with a closed end of the corresponding slot of the bracket. The retaining plat is capable of securing a vertical blind, compressed within the bracket, when the bracket is attached to the window frame. The vertical blind when positioned within the bracket by the retaining plate, is no longer capable of restricting the flow of light through the window.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved vertical blind retaining device which has all of the advantages of the prior art blind restraining devices and none of the disadvantages.

It is another object of the present invention to provide a new and improved vertical blind retaining device which may be easily and efficiently manufactured and marketed.

It is further object of the present invention to provide a new and improved vertical blind retaining device which is of durable and reliable constructions.

An even further object of the present invention is to provide a new and improved vertical blind retaining device which is susceptible of a low cost of manufacture with regard to both materials and labor, and which accordingly is then susceptible of low prices of sale to the consuming public, thereby making such vertical blind retaining device economically available to the buying public.

Even still another object of the present invention is to provide a vertical blind retaining device for providing an easy to use device for holding the vertical blinds in a compressed position against the window frame.

Lastly, it is an object of the present invention to provide a new and improved A vertical blind retaining device including a bracket. The bracket has a back member with a pair of wings projecting outwardly and extending from opposite ends of the back member. Each wing is extended at a ninety degree angle from the back member. Each wing has a slot and a plurality of mounting holes. The mounting holes are used when mounting the bracket to a wall of a window frame. Lastly, a retaining plate is seated within the slots of the bracket. The retaining plate has a bottom end with a notch cut into each corner. The notch is for coupling with a closed end of the corresponding slot of the bracket. The retaining plat is capable of securing a vertical blind compressed within the bracket when the bracket is attached to the window frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an exploded view of operable components of the present invention.

FIG. 6 is a cross sectional view of the present invention taken along line 6—6 of FIG. 5.

The same reference numerals refer to the same parts through the various Figures.

DESCRIPTION OF THE PREFERRED EMBODIMENT

Figure 1:
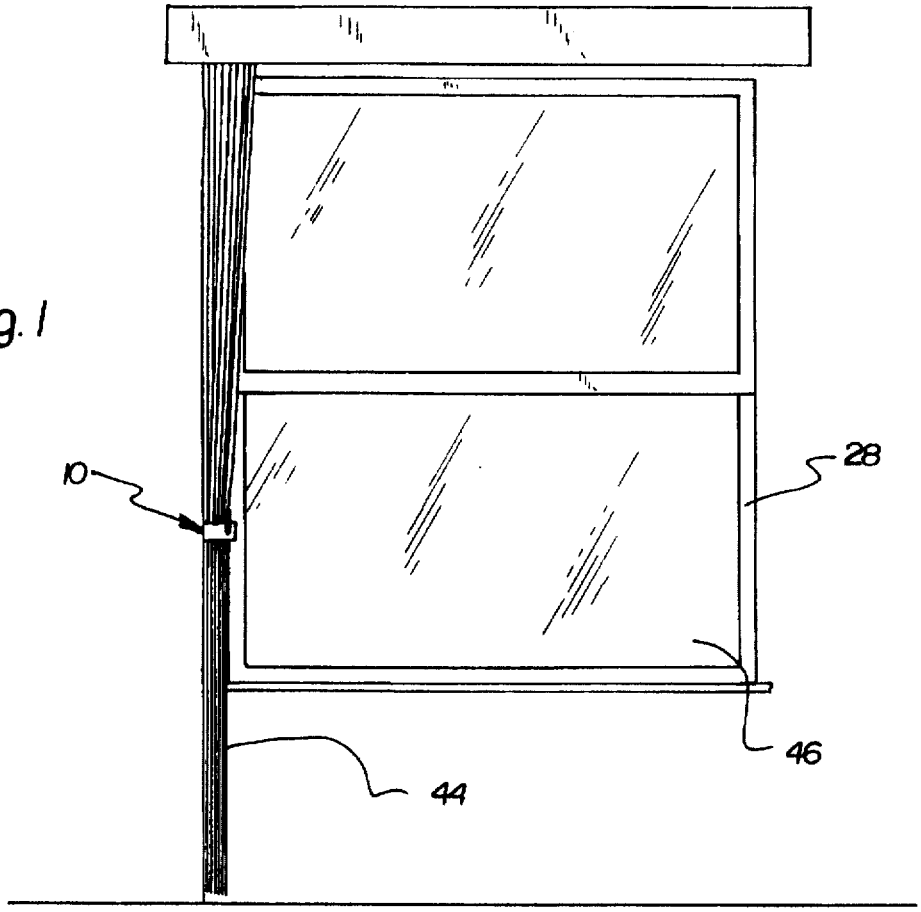
FIG. 1 is a perspective view of the preferred embodiment of the vertical blind retaining device constructed in accordance with the principles of the present invention.

With reference now to the drawings, and in particular to FIG. 1 thereof, the preferred embodiment of the new and improved vertical blind retaining device embodying the principles and concepts of the present invention and generally designated by the reference numeral 10 will be described.

The present invention, the vertical blind retaining device 10 is comprised of a plurality of components. Such components in their broadest context include a bracket and a retainer plate. Such components are individually configured and correlated with respect to each other so as to attain the desired objective.

Specifically, the present invention includes a generally U-shaped bracket 12. The bracket has a back member 14 with a pair of wings 16. Each of the pair of wings project outwardly from the back member. The pair of wings extend from opposite ends of the back member at a ninety degree angle as seen in FIG. 5. The pair of wings are in a parallel planes. The bracket has a width from about 4 inches and a height of about 1½ to about 2½ inches. The back member has a outer width of about 4 inches and an inner width of about 3¾ inches.

Also, each wing has a length of about 2 to 3¼ inches. Each wing has a slot 20 as seen in FIG. 5. Each slot of each wing has a width of about ¼ inch and a depth of about 1 to 1½ inches. The depth of the slot is dependant upon the length of its respective wing 16. The slot of each wing is about 1½ to 2½ inches from the back member.

Additionally, the bracket has a plurality of mounting holes. There are two back mounting holes 22 and two wing mounting holes 24 on each wing. As best illustrated in FIG. 6, each mounting hole is a counter sunk screw hole. The mounting holes receive screws to allowing mounting the bracket to a wall 26 of a window frame 28. The bracket may be mounted to the inside of the window frame or the outside of the window frame.

Figure 2:
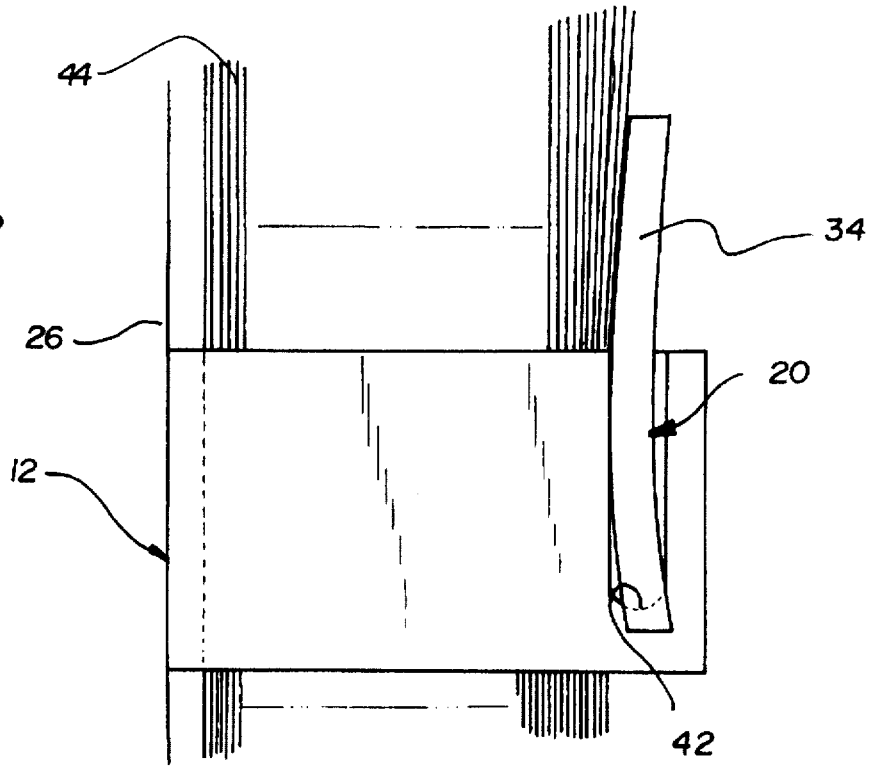
FIG. 2 is an enlarged side elevational view of the present invention of FIG. 1.
Figure 3:
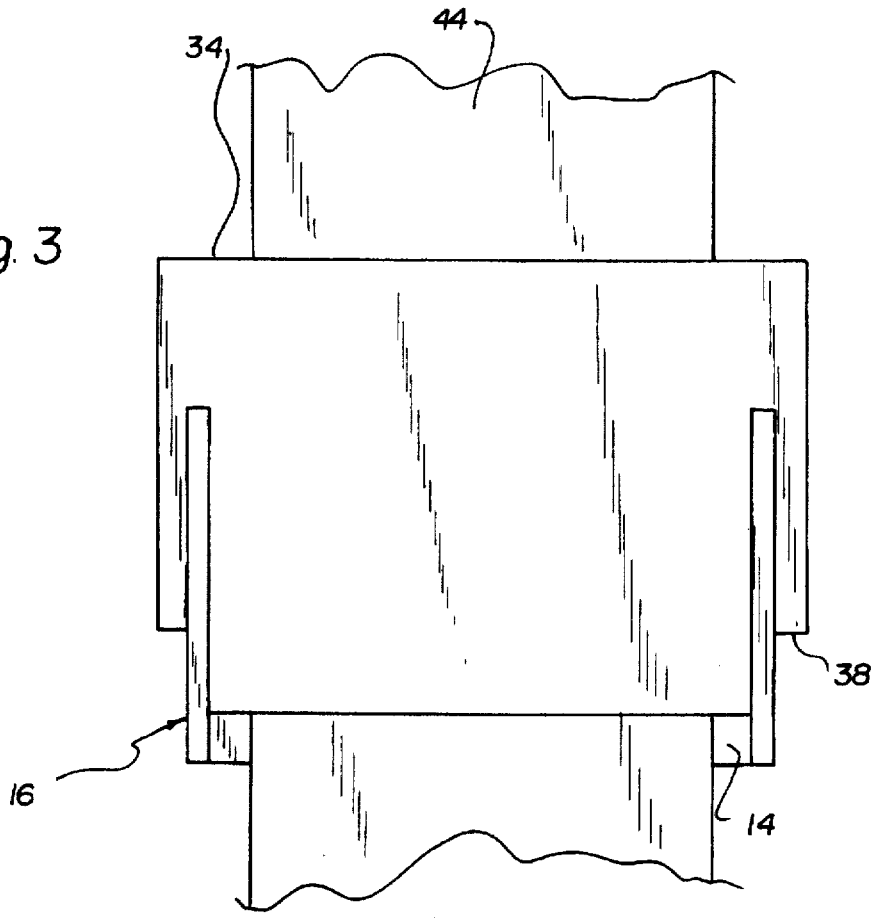
FIG. 3 is a front elevational view of the present invention of FIG. 1.
Figure 4:
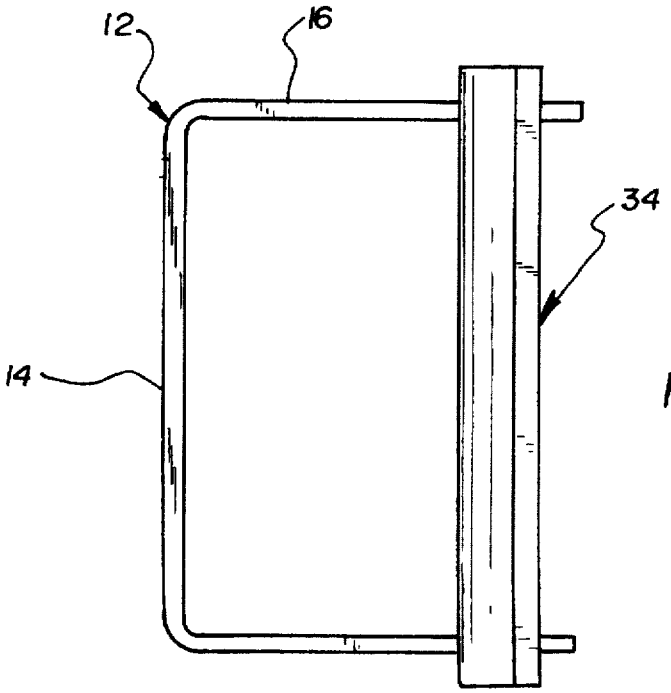
FIG. 4 is top plan view of the present invention in an operable configuration.

Lastly, a generally rectangular retaining plate 34 is seated within the slots 20 of the bracket 12. The retaining plate is slightly convex as shown in FIG. 2. The retaining plate has a width of about 4⅓ to 4¼ inches. The retaining plate has a length of about 1½ to 2½ inches and a thickness of about ⅛ inch. A bottom end 36 of the retaining plate having a notch 38 cut into each corner. Each notch is for coupling the retainer plate with a closed end 42 of the corresponding slot of the bracket 12.

Furthermore, the retaining plat will secure a vertical blind 44 compressed, as seen in FIG. 1, within the bracket when the bracket is attached to the window frame. The vertical blind when opened, by positioning it within the bracket by the retaining plate, is no longer capable of restricting the flow of light through the window 46.

The vertical blind retaining device of the present invention is made of an acrylic bracket and retaining plate. The bracket and retaining plate have the same thickness. The bracket is made of a back member with a wing extending from each end. The back member and the wings may be attached to the window frame with screw of an adhesive material. The wings of the bracket each have a slot for receiving the retaining plate. When the vertical blinds are pressed into the bracket the retaining plate is seated within the bracket. The retaining plate is slightly convex so that it may rest tightly against the vertical blind in a cradle fashion. The retaining plate, when positioned between the bracket, will not extend away from the wings more than ⅛ of an inch. The bracket and retaining plate allow the vertical blind to be held back neatly and effectively in a manner similar that resembles a tie-back for drapery. Removing the vertical blind from in front of the window allows more light to enter the room. Additionally, the present invention eliminates the swaying of the open vertical blinds when the wind blows.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved vertical blind retaining device for holding vertical blinds in a compressed manner against a window frame comprising in combination:

a generally U-shaped bracket having a back member having a front and rear surface with a pair of wings projecting outwardly from said front surface, the pair of wings extending from opposite ends of the back member at a ninety degree angle, the pair of wings being in a parallel planes, the bracket having a width from about 4 inches, the bracket having a height of about 1½ to about 2½ inches, the back member having an outer width measured across its rear surface of about 4 inches and an inner width measured across its front surface of about 3¾ inches between said wings, each wing having a length of about 2 to 3¼ inches, each wing having a slot therein with a width of about ¼ inch, each slot having a depth of about 1 to 1½ inches, each slot of each wing being spaced about 1½ to 2½ inches from back member, the bracket having a plurality of mounting holes for use when mounting the bracket to a wall of a window frame; and a generally rectangular retaining plate capable of being seated within the slots of the bracket, the retaining plate being slightly convex and having a width of about 4⅓ to 4¼ inches, the retaining plate having a length of about 1½ to 2½ inches, the retaining plate having a thickness of about ⅛ inches, a bottom edge of the retaining plate having a pair of opposing notch cuts and one of each notch cut couples with a closed end of a corresponding slot of the bracket, the retaining plate being capable of securing a vertical blind compressed within the bracket when the bracket being attached to the window frame, the vertical blind when positioned within the bracket by the retaining plate is no longer capable of restricting the flow of light through the window.

* * * * *